United States Patent [19]

Bowman

[11] Patent Number: 4,819,562

[45] Date of Patent: Apr. 11, 1989

[54] EXPLOSIVE CHARGE CONTAINING MAGAZINE FOR RAM SETTING GUN

[76] Inventor: Edward W. Bowman, 1309 Ridgeway Avenue, North Vancouver, British Columbia, Canada, V7L 3R9

[21] Appl. No.: 138,431

[22] Filed: Dec. 28, 1987

Related U.S. Application Data

[63] Continuation-in-part of Ser. No. 93,302, Sep. 4, 1987, abandoned, which is a continuation-in-part of Ser. No. 243, Jan. 2, 1987, abandoned.

[51] Int. Cl.[4] ..... F42B 39/08; C06C 7/02

[52] U.S. Cl. ..... 102/281; 102/530

[58] Field of Search ..... 102/281, 530, 531

[56] References Cited

U.S. PATENT DOCUMENTS

| | | | |
|---|---|---|---|
| 2,918,868 | 12/1959 | Ringdal | 102/530 |
| 3,087,428 | 4/1963 | Frech | 102/531 |
| 3,144,827 | 8/1964 | Boutwell | 102/530 |
| 3,318,245 | 5/1967 | Ferri et al. | 102/281 |
| 3,349,710 | 10/1967 | Sposimo | 102/281 |
| 3,354,571 | 11/1967 | Parker | 102/530 |
| 3,583,087 | 6/1971 | Huebner | 102/530 |
| 3,611,870 | 10/1971 | Udert | 102/530 |
| 3,625,153 | 12/1971 | Gawlick et al. | 102/281 X |
| 4,036,103 | 7/1977 | Gawlick et al. | 102/281 |
| 4,056,062 | 11/1977 | Walser et al. | 102/281 |
| 4,098,169 | 7/1978 | Gawlick et al. | 89/35.01 |
| 4,294,173 | 10/1981 | Ferri | 102/281 |
| 4,406,079 | 9/1983 | Buechel et al. | 102/281 |
| 4,565,114 | 1/1986 | Burdick et al. | 102/531 |

FOREIGN PATENT DOCUMENTS 2097899 10/1982 United Kingdom .

*Primary Examiner*—David H. Brown

*Attorney, Agent, or Firm*—Fulwider, Patton, Rieber, Lee & Utecht

[57] ABSTRACT

A propellant containing device for use in association with a gun with a detonator mechanism and drive mechanism for the purpose of driving an attachment member into a structure. The device has an elongate or circular base. A plurality of cartridge members are formed integrally with the base and each member contains an explosive charge. The base and the cartridge members are formed in one piece from a material selected from plastic or ceramic. The region of the cartridge members integral with the base are closed by a cap which is adapted to fit within a recess formed in the periphery of the closed ends of the cartridge members. The cap is adapted to be hit by the detonator mechanism to detonate an explosive charge located in the cartridge member. A drive engagement fitting on the base allows the base to be moved progressively so that each cartridge member aligns successively with the detonator mechanism of the gun.

28 Claims, 4 Drawing Sheets

EXPLOSIVE CHARGE CONTAINING MAGAZINE FOR RAM SETTING GUN

CROSS REFERENCE TO RELATED APPLICATION

This application is a continuation-in-part of my application ser. No. 093,302, filed Sept. 4, 1987, now abandoned, which is a continuation-in-part of my application ser. No. 000,243, filed January 2, 1987, now abandoned, the disclosures of which are incorporated herein by reference.

FIELD OF THE INVENTION

The present invention relates to a plastic cased propellant (explosive) magazine for use in a powder driven bolt setting gun. In particular, it concerns a magazine comprising a series of equally spaced propellant (explosive) encasing cases, each case having a metal base enclosure and a skirt integrally formed with the interior wall of the case proximate the metal base enclosure.

BACKGROUND OF THE INVENTION

The widespread use of poured concrete in buildings, especially commercial buildings, has a number of virtues, including a great reduction in fire risk, speed and ease of production, and low noise transmission between floors. In concert with the growth in the erection of concrete buildings, a variety of devices have been developed to assist in the attachment of fittings and equipment, particularly, electrical and plumbing fittings, to such buildings. Although it is relatively easy to drill a hole in concrete and to insert an anchor therein, it is a relatively time consuming procedure compared with simply driving a nail or a staple in wood.

This problem has led several manufacturers to develop and sell products to the construction industry known generally as powder actuated tools, explosive actuated tools, bolt setting guns, power hammers, RAMSET (trade mark) guns or Hilti (trade mark) guns. The concept common to all these devices is the use of an explosive or propellant charge, which is detonated inside a hand-held gun, to propel a metal object such as a threaded bolt into a hard surface, typically a concrete wall. These guns are used extensively by electricians and plumbers so that plumbing pipes and electrical cables may be hung on the fastening devices fixed in the concrete.

Disposable magazines for use in explosive powder driven bolt setting guns have been known and certain disadvantages have been experienced with types of propellants formed with non-ferrous metal casings as well as with caseless propellant charges.

Manufacturers currently manufacture the cartridges or containers for the explosive charges by deep-drawing brass into a shape resembling a small calibre bullet except that there is no slug at the top of the bullet. At least one manufacturer inserts the cartridges into a plastic strip so that the gun can be used in a semi-automatic fashion rather than a single shot mode. Typically these devices include drive engaging means (eg. notches) formed on the strip so that the strip can be advanced by the gun and properly aligned with the firing hammer or detonating pin in the gun to thereby explode the respective charge.

A serious problem with the constructions disclosed in the prior art is high expense. Typically the magazine component that contains the propellant is a two component system comprising a plastic carrier, having a series of holes, and brass cartridges that fit into the holes. Brass is expensive, and the deep-drawing of brass is a complex expensive art.

The primary disadvantage experienced with cartridge shells formed from non-ferrous metal such as brass is raw materials expense and manufacturing expense to form the cartridge shell. The metal must be annealed several times before cartridge forming is completed. Because of such cost, several variations of caseless propellants have been known, which for reasons of expense and safety were intended to completely eliminate the use of non-ferrous metals.

A further disadvantage with cartridge shells formed from non-ferrous metal occurs where hot burning gases from ignition unintentionally leak into the firing mechanism of the tool. Yet a further disadvantage of cartridge shells formed from non-ferrous metals is that regardless of the powder load used, the interior volume of the shell is not variable. A common method of reducing the firing impact for light loads is to dilute the powder with paper or other fillers. This creates an undesirable result because it increases the amount of residue and impurities that can penetrate into the firing mechanism of the tool.

Caseless charges have been designed in order to avoid the expense of deep drawing non-ferrous metals. Disadvantages have been experienced with such caseless charges however, because dangerous ignition of adjacent propellant charges has sometimes occurred due to lack of a combustion sealing mechanism between the cartridges. A caseless charge magazine which eliminates this danger is disclosed in U.S. Pat. No. 4,406,079 which describes a strip of caseless charges wherein the propellant charge is displaced into the gun for ignition. Because of this requirement, the system is incompatable with one of the more widely used types of guns because substantial differences occur in the type of powder actuated gun in which the propellant can be used.

The following references disclose subject matter which is pertinent to the technology of gun powder or explosive actuated tools and explosive firing devices (guns).

U.S. Pat. No. 2,918,868, Ringdal, issued December 29, 1959 discloses an invention relating to a cartridge comprising a base having a tubular extension and a case which consists of relatively elastic flexible synthetic resin material, such as polyethylene or polyvinylchloride. The attachment of the case and cartridge base to each other is secured by means of a bead on the one member in engagement with a corresponding groove in the other member.

U.S. Pat. No. 3,318,245, Ferri et al., issued May 9, 1967 discloses strip ammunition for toy guns wherein a plurality of discrete explosive charges are contained in container means. Stalk means interconnects each container means, Stop means are formed on the stalk means for engagement by an advancing means of a toy gun. In this way the strip can be advanced by the space between each container means each time the gun is fired.

U.S. Pat. No. 4,294,173, Ferri, issued October 13, 1981, discloses ammunition for a toy-weapon comprising an injection molded support having seats for explosive charges. The charges are sealed within the seats by a separate cover for each seat. The covers are injection moulded simultaneously into the seats of the support.

U.S. Pat. No. 3,349,710, Sposimo, issued October 31, 1967 discloses a strip carrier for explosive socket caps for toy guns. The explosive is encased in wells which are capped by a series of caps strung together in series.

U.S. Pat. No. 3,583,087, Huebner, issued June, 1971 discloses a certain design of magazine.

U.S. Pat. No. 3,611,870, Udert, issued October, 1971, discloses a cartridge magazine construction in which the cartridge is placed in a narrow band having a plurality of tubular projections formed therein. Each projection holds a single cartridge.

Gawlick et al. have been active in this area. U.S. Pat. No. 3,625,153, issued December, 1971, discloses a plurality of plastic propellant cases formed in series on a base.

U.S. Pat. No. 4,036,103, Gawlick et al., issued July 19, 1977, disclose a magazine apparatus for accommodating propellant charges including a flat coilable metal strip having a plurality of holes extending transversely therethrough for accommodating the insertion of cartridges. Cartridge holding collars are formed at each of the holes by bulging or plastically deforming the strip in the region of these holes so as to form a clamping seal spaced from the plane of the strip for clampingly engaging cartridges held at the strip. Various preferred embodiments include various cross-sectional configurations of the holding collars. The method of making the magazine apparatus includes forming the collars by a multiple-step bulging process wherein the last bulging step is formed by the cartridges as they are inserted into position on the strip.

U.S. Pat. No. 4,098,169, Gawlick et al., issued July 4, 1978, discloses an ammunition belt apparatus for accommodating propellant cartridges including a flexible, coilable belt strip, a plurality of holes extending transversely through the strip and spaced from one another in the longitudinal direction of the strip. Clamping means are associated with each of the holes for clamping a cartridge to the strip with portions of the cartridge extending through one of the holes. Parts of the clamping means are formed separately from the strip and the cartridge. In preferred embodiments, the clamping means includes a tubular casing formed separately from the strip for each of the holes. The tubular casing press-fittingly engages a respective cartridge for holding the cartridge in position on the strip with the casing. A cartridge rim clamps the strip therebetween.

U.S. Pat. No. 4,056,063, Walser et al., issued November 1, 1977, discloses a magazine for use in an explosive powder driven bolt setting gun. A cartridge holding space for a caseless charge is formed by the combination of a cartridge recess in a band-shaped magazine body and a torus-shaped body superimposed on the magazine body to form an extension of the recess. Various configurations of the cartridge holding space and the exterior of the torus-shaped body can be used. A variety of openings can be provided through the cartridge holding space to prevent destruction of the magazine parts when the caseless charge is ignited.

U.S. Pat. No. 4,406,079, Buechel, issued September 27, 1983, discloses a magazine for caseless propellant charges, such as those used in a fastening element setting device. The magazine consists of an elongated strip-like member. Cut-outs are provided in the strip-like member and a caseless charge holder is secured in each cut-out by webs. A caseless charge and the holder are displaced out of a cut-out when a sufficient force is directed against the holder to separate the webs from the strip-like member.

U.S. Pat. No. 4,565,114, Burdick et al., issued January 21, 1986, discloses a cartridge magazine for holding cartridges for feeding to the barrel of an explosion driven fastener setting tool. The magazine comprises an elongated flat flexible strip or band preferably made of an inexpensive material such as plastic. The strip includes a plurality of stepped projections defining cartridge holding recesses arranged at equally spaced locations along the strip and lateral recesses for advancement. Each cartridge holding recess is defined by a stepped projection extending upwardly from the strip which on its exterior is stepped inwardly in a direction toward the tip of the cartridge. The angular taper of each of the outside walls of this portion on the cartridge magazine is slightly less than one cone angle of the cartridge chamber of a gun barrel with which it is to be employed. In this way there is more than one sealing point between the projections and the inner wall of the cartridge chamber.

SUMMARY OF THE INVENTION

The present invention provides a plural explosive (propellant) containing device which is useful in association with a gun to drive an attachment member into a structure, particularly a concrete structure. The device minimizes the use of expensive drawn non-ferrous metal. The device is less expensive to manufacture than prior art devices.

In particular, the invention pertains to a propellant containing device for use in association with a gun which may be adapted to utilize the propellant to drive an attachment member into a structure comprising: (a) a base; (b) means on the base to enable the base to be moved by a movement mechanism in the gun; (c) a plurality of hollow members each integral with the base, the members being closed at the end removed from the base and open at the end adjacent the base, each opening in the base having an annular groove therearound; and (d) a plurality of closure means adapted to fit within the openings in the base, each closure means having a peripheral rim which fits in the annular groove surrounding the opening of the base.

A device wherein the rim of the closure means may have a projection thereon which enhances mating of the rim of the closure means with the annular groove. In the device, the width of the interior of the annular groove may be expanded relative to the exterior region of the groove, the expanded interior of the groove being adapted to mate with the projection of the rim of the closure means to enhance and maintain the assembly of the closure means and the base. The projection may extend inwardly from the edge of the peripheral rim.

The invention also pertains to a device wherein the portion of the base between the opening and the opening facing side of the annular groove may extend to a length sufficient to provide a barrier between the interior of the hollow members and the closure means when assembled. In the device, the thickness of the wall of each of the hollow members may be less at the region of the members remote from the base and greater at the region of the members proximate to the base. The exterior surface of each of the hollow members may be in the form of a cone with a rounded top remote from the base. In the device, the rounded top region of the conical hollow member can be weakened by at least one crease.

The device may have means on the base for permitting movement of the base by the gun, comprising a series of discrete openings on at least one side of the base which openings are adapted to engage a drive mechanism in the gun. The closure means may be formed of non-ferrous metal or plastic.

In the device, the interiors of the hollow members may contain gunpowder and primer. The primer may be adjacent the closure means. The gunpowder may be in the form of a tablet. In the device, the interiors of the hollow members may contain gunpowder, and a primer which is, in part, enclosed between two opposing non-ferrous metal pieces. Piezoelectric means may be associated with the closure means and utilized to ignite the primer.

In the device, the exterior surface of the cone may have thereon at least one raised portion. The raised portion may extend around the circumference of the cone. The device may include a peripheral channel on the inner surface of the bottom of the annular groove and a flange extending inwardly from the rim of the closure means adapted to engage the channel to secure the closure means to the member.

The invention is also directed to a propellant containing device for use in association with a gun which may be adapted by means of a detonation device to utilize the propellant to drive an attachment member into a structure. The device may comprise: (a) a base: (b) drive receiving means formed on the base whereby the base may be driven to align with the detonation device; (c) a plurality of hollow cartridge members formed integrally with the base, each cartridge member being open at the base and containing an explosive charge; (d) a percussion cap adapted to fit in each cartridge opening, the cap holding a primer to ignite the explosive charge in the cartridge member; (e) a circumferential recess around the opening in each cartridge member to receive the respective percussion cap, the circumferential recess having a widened portion at its inner end remote from the base; (f) a circumferential skirt defining a radially inward surface of the recess and separating the recess from the interior of the respective cartridge members, the skirt extending from the widened portion of the circumferential recess to a position proximate to the percussion caps; and (g) an upstanding wall formed around the periphery of each percussion cap to engage the interior of the recess; the upper end of the upstanding wall having a flange to engage the widened portion of the circumferential recess.

In the device, the cartridge member may be closed at the end remote from the base. Lines of weakness may be formed in the closed end of the cartridge member. The cartridge may be molded from a heat extrudable polymer selected from polyvinylchloride and polyethylene. The percussion cap may be formed of brass. The base may be elongate or circular.

DRAWINGS

In drawings which illustrate detailed embodiments but which should not be construed in any way as restricting the spirit or scope of the invention:

DETAILED DESCRIPTION OF SPECIFIC EMBODIMENTS OF THE INVENTION

To improve the economy of bolt setting guns using rim fire ignition methods, the present invention proposes a substantially reduced usage of non-ferrous metal. This is done by utilizing a plastic skirt embodiment to seal hot burning ignition gases rather than a fully enclosing cartridge shell of non-ferrous metal and crimping it shut. It is a known fact that forming a cartridge shell to a length to permit crimping at the open end requires deep drawing of the non-ferrous metal utilizing several successive annealing and cleaning processes. This requirement necessitates the acquisition and maintenance of complex machinery and much labor. The present invention describes a base closure of non-ferrous metal which is formed with no requirement of annealing. It can therefore be accomodated with one passing through a progressive die. As well, the base closure cap has a radial inward or outward curl at its open end, which, upon assembly into the plastic casing, locks into an undercut recessed into the skirt formed integrally with the plastic casing. A further advantage of the base closure cap is the increased efficiency with which the explosive primer can be spotted into the radial base rim because of the shorter distance to the opening end of the closure cap.

The subject invention describes a cylindrical skirt embodiment formed integrally with the main body of the thermo-plastic casing. This skirt embodiment is formed with an undercut at its upper end to house an inward or an outward radial projection formed into the wall of the closure cap, thereby locking it tightly into place to prevent accidental disassembly of the propellant. It also makes it difficult for persons to disassemble the device and gain potentially harmful access to the gunpowder. Further, the undercut is formed to exert outward pressure on the opening end of the closure cap thereby forming a seal. Upon ignition, where the lip of the base closure cap curls inwardly, the expanding gases within the plastic casing force the skirt embodiment tightly against the inner rim of the closure cap thereby sealing the potential exit of the burning gases between the closure cap and the plastic casing. The skirt embodiment is formed in one piece with the main body of the plastic casing thereby eliminating separation as with a prior device, for example, as shown in U.S. Pat. No. 2,918,868, Ringdal.

Figure 1:
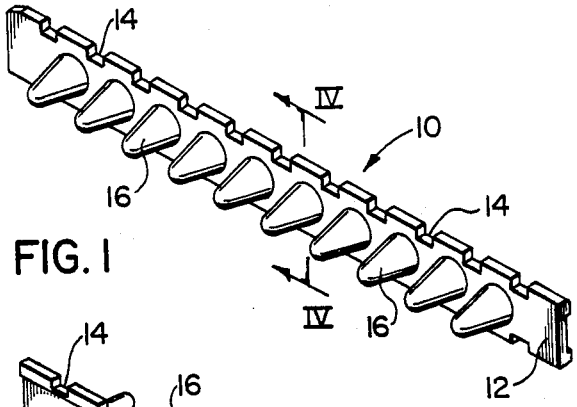
FIG. 1 depicts a frontal isometric view of the linear embodiment of the propellant (explosive) containing device.
Figure 2:
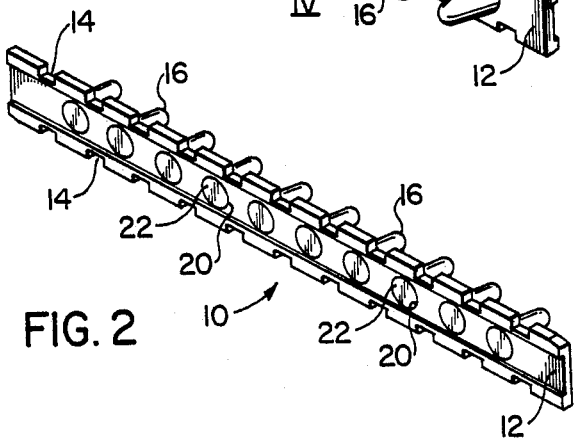
FIG. 2 depicts a rear isometric view of the linear embodiment of the propellant containing device.

Referring now to the drawings, FIGS. 1 and 2 depict front and rear isometric views of the propellant (explosive) containing device 10 which is useful in a ram-set gun or power hammer to drive an attachment member into a structure. Such guns are conventional and well known in the art. A depiction of one type of commonly used gun appears in U.S. Pat. No. 4,406,079 issued Sept. 27, 1983.

As illustrated in FIGS. 1 and 2, the propellant containing device 10 of the present invention comprises an elongate base 12 which is of precisely the same design as bases used in the prior art and in commerce. Drive means in the form of a series of evenly spaced slots 14 are formed along each side of the elongate base 12. In this way, the device 10 may be driven by the drive means of a typical ram-set gun in intermittent stages past a point, typically the detonation pin of the ram-set gun. A plurality of rounded conical cartridge members 16*a* are distributed evenly along the base 12 and are formed integrally with the base 12 by a suitable technique such as injection molding. The propellant containing device 10 can be formed in one piece from a suitable material such as a plastic (polyethylene or polyvinylchloride) or a ceramic.

In the embodiment depicted in FIGS. 1 and 2, the cartridge member 16*a* is formed so that it has an open end 20 at the elongate base 12. A closure cap 22*a* is placed in the open end 20 of each cartridge member 16*a*. The closure cap 22*a* is typically constructed of metal, for example, brass, which, in certain circumstances, is better adapted than plastic to receive the blow of the striking detonation pin of a ram-set gun. The embodiment depicted in FIGS. 1 to 4, and most clearly in FIG. 3, has a hollow cylindrical-like cavity 24 in the interior of the cartridge member 16*b*. The wall between the exterior of the cartridge member 16*b* and the cavity is of a tapered thickness (see FIGS. 3 and 4) with the thicker end adjacent the base 12. A circular bulb-ended opening 26 is formed in the wall of the cartridge member 16*b* between the cavity 24 and the base 12. A curved lip 28*a* extends outwardly from the rim of the metal cap 22*b*. This lip 28*a* engages the bulb-end of the opening 26 and snuggly secures the metal cap 22 in position to close opening 20. By this means, once the cavity 24 of the cartridge member 16*b* has been loaded with charge and primer, the metal cap 22*b* is pushed home and secured in position by the lip 28*a* engaging the bulb-like end of opening 26.

Figure 3:
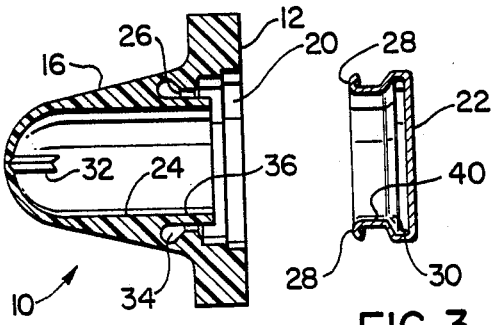
FIG. 3 depicts an exploded section view of the two components forming the propellant containing device.

Cap 22*b* has an internal peripheral channel 30 at its base. Channel 30 is designed to receive the primer which, upon strong impact, detonates the charge contained in the main body of cavity 24 of cartridge member 16*b*. FIG. 3 also illustrates a weakness crease 32 which is formed in the top region of the cavity 24 remote from opening 20 and cap 22*b*. Typically, the crease 32 can be formed in the shape of an "X". The crease 32 assists in enabling the detonated charge contained in cavity 24 bursting through the top of the cartridge member 16*b* into the barrel of the ram-set gun.

A shortcoming inherent in forming prior art propellant (explosive) containing devices for use in a propellant driven bolt setting gun, where the device is molded in one piece, has been reverse leakage of gas which is generated upon ignition and leaks rearwardly into the action or breach of the gun rather than forwardly into the working barrel of the gun. For propellant containing devices of the prior art, where deep drawn brass casings are used, not only is there high cost involved but also there is the expense of installing the priming composition into the percussion cap rim (channel 30). This can be an awkward and expensive procedure because of the depth of the persussion cap.

The embodiment depicted in FIGS. 3 and 4 avoids these disadvantages by the use of subtle design features which will be explained below in detail. The embodiment illustrated in FIGS. 3 and is particularly characterized by a circumferential opening 26 at the base of each cartridge member 16*b*, 16*c*. This opening 26 receives the upwardly extending circular wall 40 of the percussion cap 22*b*, 22*c*. The height of the wall 40 is substantially less than the height of the walls of conventional deep drawn brass cartridges, thus minimizing the complexities and expense of deep drawing metal. The upper region of opening 26 is widened in the form of a bulb 34*a*, 34*b*. The inner wall of opening 26 facing cavity 24 forms a downwardly extending circumferential skirt 36*a*, 36*b*. This skirt 36*a*, 36*b* separates the opening 26 from the interior 24 of the cartridge member 16*b*, 16*c*. The circumferential skirt 36*a*, 36*b* extends from the widened bulb portion 34*a*, 34*b* to a point close to the interior of the base of the percussion cap closure 22*b*, 22*c*.

The percussion cap 22*b*, 22*c* has an upstanding wall 40 which abuts the outer wall of the opening 26. A inwardly curved lip 28*b*, or outwardly curved lip 28*a*, at the upper end of the upstanding wall 40 is received in and engages the widened portion 34*a*, 34*b* of the circumferential opening 26. The lip 28 is curved inwardly to ease assembly of the cap 22*c* into the opening 20 of the cartridge member 16*a*. However, the lip 28*a* could be curved outwardly if it was considered advantageous for some reason.

Figure 4:
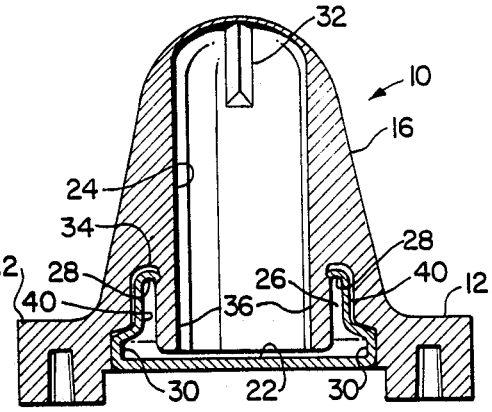
FIG. 4 depicts a section view taken along section line 3—3 of FIG. 1.

The advantages of the structure depicted in FIGS. 3 and 4 compared to prior art constructions are considerable. The skirt 36*a*, 36*b* acts as a sealing member against the wall 40 of the percussion cap 22*b*, 22*c*. The skirt 36*a*, 36*b* prevents gases generated by ignition of the primer and charge from reverse escaping between wall 40 and member 16*b*, 16*c* into the breach action of the firing gun. Specifically, gas pressures generated by ignition of the primer and gunpowder in the interior of cap 22*b*, 22*c* and cavity 24 deflect the plastic skirt 36*a*, 36*b* radially outwardly against the circumferential metal wall 40 of the percussion cap 22*b*, 22*c*. The sealing effect is proportional to the gas pressure because the greater the pressure, the greater the outward deflection of skirt 36*a*, 36*b*. Thus the explosion pressures are utilized as a main component of the gas sealing mechanism. The sealing mechanism is enhanced further by forcing wall 40 against the outer wall of opening 26.

While the percussion caps 22*b*, 22*c* are merely push fit into opening 26, and not adhesively sealed in any way, they are nevertheless held tightly in association with the cartridge members 16*b*, 16*c* because the lip 28*a*, 28*b* fits snugly within the widened portion 34*a*, 34*b* thereby providing resistance to uncoupling of the cap 22*b*, 22*c* and the member 16*b*, 16*c*.

The thickness of the wall of member 16*b*, 16*c* is tapered upwardly so that the thin section is at the top remote from the cap 22*b*, 22*c* and opening 20. This encourages the gases generated upon ignition of the primer and charge to expell upwardly, and split open the top of the member 16*b*, 16*c* through creases 32. The detonation gases are then directed into the barrel of the ram-set gun rather than rearwardly into the breach of the gun.

To form the device of FIGS. 3 and 4, including propellant, the cavity 24 of cartridge member 16*b*, 16*c* is filled with powder (not shown) and the channel 30 of cap 22*b*, 22*c* is charged with a detonator charge (primer). The cap 22*b*, 22*c* is non-removeable and is held tightly by the cartridge member 16*b*, 16*c* and base 12. The dimensions are specified so that the firing pin will impact in one of two identified locations on the base of the circumference 30 of the primer cap 22*b*, 22*c*. The detonator charge (primer) present in the cap 22*b*, 22*c* may simply be spot located in the cap 22*b*, 22*c* and in order to be effective need not occupy the full circumference of the cap as in prior devices in order to be effective. A further advantage of spot locating the primer is that simpler and less expensive methods of inserting the primer compound in the primer cap can be used, compared to using a complex method of locating the primer fully throughout the circumference of the rim 30 of the primer cap 22*b*, 22*c*. A relatively inexpensive method of spot locating the primer compound in the channel 30 can be injection by compressed air.

The skirt 36*a*, 36*b* apart from its inherent sealing qualities has the advantage that it allows the cavity 24 of the cartridge member 16*b*, 16*c* to hold more powder without interfering with the fit of cap 22*b*, 22*c* in the opening 20 of the cartridge member 16*b*, 16*c*.

Figure 5:
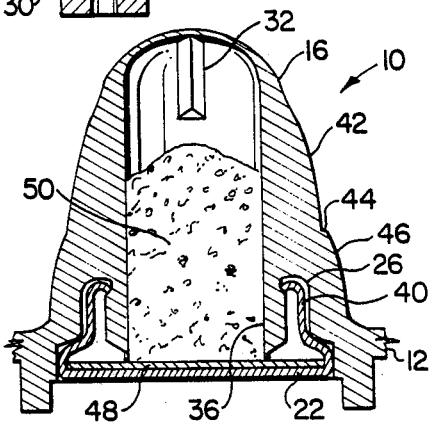
FIG. 5 depicts a section view of a variation of the propellant containing device having a stepped exterior.
Figure 6:
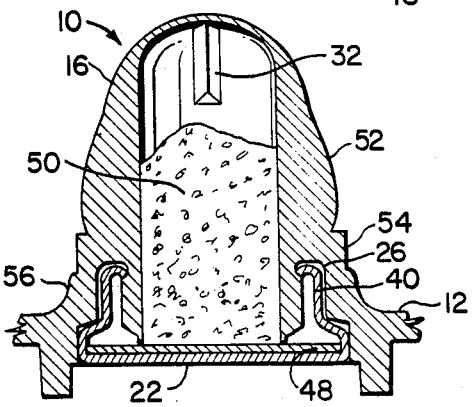
FIG. 6 depicts a section view of a second variation of the propellant containing device having a stepped exterior.

FIGS. 5 and 6 illustrate variations of the device 10 where the external wall of each conical projection 16*d*, 16*e* is a stepped projection extending upwardly from the base 12. The exterior is stepped inwardly in a direction toward the upper tip of the cartridge 16. The angular taper of each of the outside walls of the plastic propellant casing is designed so that it is slightly less than the cone angle of the cartridge chamber of the gun in which it is to be fired. In this way, there is more than one sealing point between the shoulders of the steps and the inner wall of the propellant chamber of the gun. The steps not only serve to seal the chamber at multiple points but together with the conical wall of the cartridge chamber of the gun define two shock absorption cavities between them.

The plastic material used to form the device 10 should have superior tensile strength and be specifically blended to withstand burning gases, heat, and pressures that are generated upon ignition of the propellant (explosive). The cartridge chamber should have a greater cone angle than each of the steps on the external wall of the plastic casing. The cone angle of the stepped part of the magazine should be slightly less than the cone angle of the conical cartridge chamber. This enhances the seal at the top of the projection to decrease the exposure of the exterior of the projection to the hot burning gases that are generated on ignition. This design also creates an increased compressive stress on the plastic material of the plastic casing so that the cavities will be compressed to serve their intended sealing and ejection aiding function. When the firing pin strikes the rim of the base closure cap 22*c*, the increased compressive stress will assist the closure cap 22 to yield axially thus keeping the necessary ignition energy low (i.e. the firing pin does not need to hit the rim as hard).

The stepped structure of the projections is designed so that the plastic propellant casing will not lock itself into the chamber of the tool before or after ignition. The steps in the exterior wall of the cartridge member act as sealing rings with the chamber wall of the gun and provide greater compressive force than is the case with a smooth conical projection. This design greatly reduces gas leaks upon ignition.

Referring specifically to FIG. 5, which depicts a preferred embodiment of a stepped design, it can be seen that there are two arcuate sealing shoulders 42 and 46. The first shoulder 42 and the second shoulder 46 define between them a shock absorption cavity 44 which serves as a high pressure gas pressure absorption space. Cavity 44 assists the sealing action both before and during firing and assists in ejection of the member 16*d* from the cartridge chamber of the gun after detonation.

In the embodiments illustrated in FIGS. 5 and 6, the primer 48 is located on the interior base of the cap 22*c* and the gunpowder 50 is positioned in the interior cavity 24.

FIG. 6 illustrates a section view of an alternative design of exterior stepped cartridge member 16*e*. This design has a first arcuate shoulder 52 and a second arcuate shoulder 56, which are separated by a right angle shoulder 54, to define two gas pressure absorption cavities. This is in contrast to the single cavity 44 depicted in the device 10 illustrated in FIG. 5. In certain instances, it may be found by experimentation that it is preferable to have two gas pressure cavities to assist in sealing action.

Figure 7:
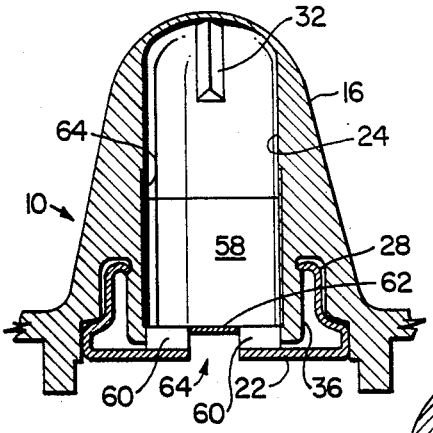
FIG. 7 depicts a section view of a variation of the propellant containing device adapted for use with a solid propellant tablet.

Another variation of the invention is illustrated in FIG. 7. FIG. 7 is a section view of an embodiment of the device utilizing a solid propellant in tablet form. Device 10 includes a solid pressed gunpowder tablet 58 rather than loose gunpowder. The plastic cavity 24 is loaded by pouring or pressing the tablet 58 in place while it is still wet. The powder tablet 58 is spaced from the internal floor of the closure cap 22*d* by means of a thermal plastic washer 60. Ignition is initiated by means of a conventional center fire priming device, or a piezoelectric electric device 62 as shown in FIG. 7. The closure cap 22 has a central hole 64*d* formed therein to enable entry of the firing mechanism. If desired, a plurality of channels 65 can be formed in the interior wall of the plastic casing 16*f*. The purpose of such channels 65 is to allow upon ignition a flow of burning gases from all areas on the circumference of the solid powder tablet 58 to the barrel of the gun (not shown).

This design is distinct from Walser and Buechel. The Walser device does not work and is dangerous because it detonates adjacent propellants. Both Buechel and Walser are caseless charges which use no metal parts at all. Buechel must be used in a gun which removes the propellant from the strip and seals it into the chamber of the gun before ignition, thereby making the gun more complex to manufacture and operate. It also makes it incompatible with the most commonly available powder actuated tools utilizing rim-fire technology. Also Buechel is not a rim-fire mechanism, but a piezoelectric-electric or gas plasma fired propellant.

Figure 8:
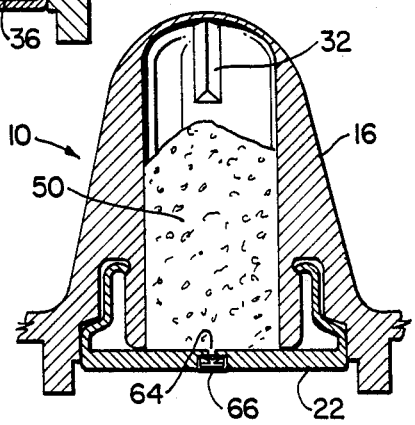
FIG. 8 depicts a section view of a variation of the propellant containing device adapted for use with a centre fire primer.

FIG. 8 illustrates a sectional view of a variation of the device 10 with a thicker base for the cap 22*b*. This provides enhanced protection against detrimental reverse explosion forces. The base of the cap 22*b* has a central pin opening 64*b*, with a centre fire precussion cap 66, for ignition action. The design of the cap 66 is conventional.

The embodiment shown in FIG. 8 varies from that of FIG. 7 in that it uses a centre-fire primer rather than a rim-fire mechanism. Because of the lack of rim-fire primer, the skirt does not have the very thin end tip at the radial circumference. The base of the metal closure cap 22e should preferably be formed of a thicker material in order to accommodate the center-fire priming device.

Figure 9:
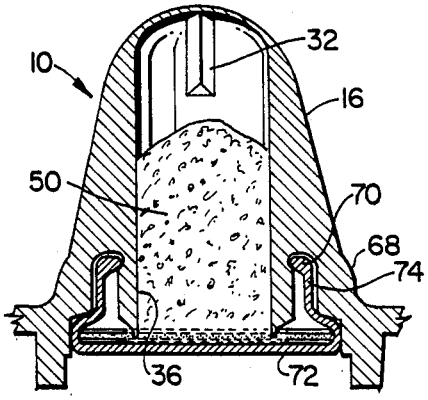
FIG. 9 depicts a section view of a variation of the propellant containing device adapted for use with a plastic base closure cap.
Figure 10:
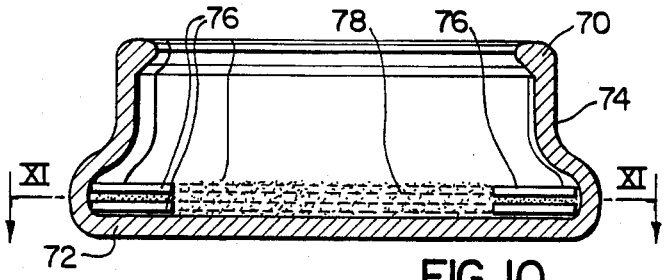
FIG. 10 depicts a section view of the plastic base closure cap of FIG. 9.
Figure 11:
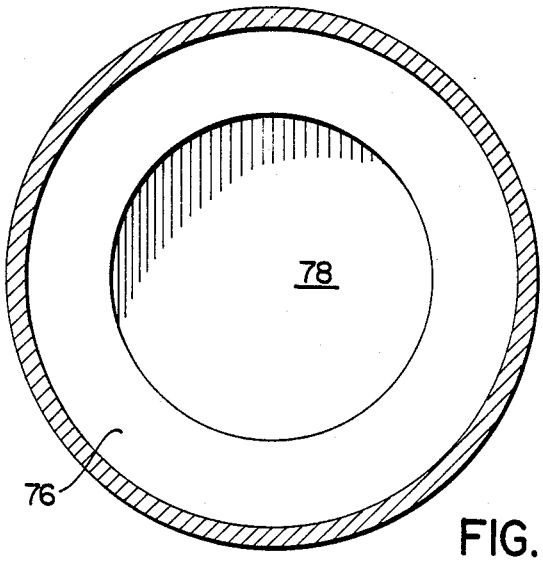
FIG. 11 depicts a plan view of the plastic base closure cap.

FIGS. 9, 10 and 11 illustrate an embodiment of the device 10 wherein the cap 72 is formed of a high tensile strength thermal plastic such as a carbon-fibre impregnated nylon rather than a non-ferrous metal (brass). This has the advantage of reduced cost. A single shoulder step 68 is formed on the exterior of the cartrige 16h. The skirt 36c on the exterior of the cartrige 16h has the same function as in the embodiments of the propellant device previously described. The molded inward curl 70 of the upper end of the plastic closure cap 72 has a rounded shape which deters collapse of the curl 70 and rim 74 during assembly.

By being molded integrally with the main body of the casing, the expense of separate molding processes and assembly processes are eliminated. In FIG. 9 the lowermost tip of the skirt 36c narrows to a substantially reduced thickness so that the thermal plastic material will be more easily displaced by the detonation of the priming compound. This enhances the ignition of the gunpowder within the plastic casing. At the same time, this design provides assistance to the assembly process by forming a slanting edge which allows the inner radial lip of the closure cap to displace the plastic skirt upon assembly. The resilience of the plastic causes the skirt to return to its original position once the inner radial rim of the closure cap has seated in the undercut 34b of the skirt.

The embodiment illustrated in FIGS. 9 to 11 has a base closure cap 72 formed from plastic rather than non-ferrous metal. Notwithstanding, this embodiment is useable in a conventional powder actuated gun which requires rim-fire propellants. Rim-fire technology requires that the rim of the propellant closure, when struck by the firing pin of the gun, is compressed between two pieces of metal, thus causing the primer to detonate. To facilitate this, one surface of each of two rings 76 of non-ferrous metal are coated with priming compound 78 and are then molded into the closure cap 72 as it is formed. In order to prevent detonation of the priming compound 78 by the heat of the injection molding process, a slow drying additive is blended into the priming compound while it is still in water-based slurry form. Further priming occurs after the non-ferrous metal rings 76 are formed within the plastic closure cap 72 by coating the interior base of the closure cap 72 with a common mixture of priming compound.

Figure 12:
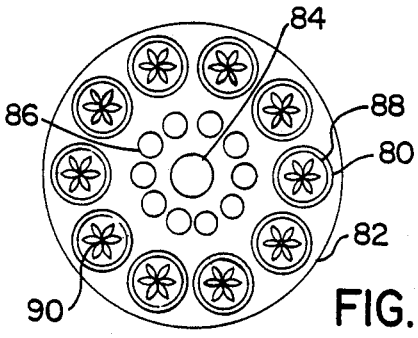
FIG. 12 depicts a frontal view of a circular embodiment of the propellant containing device.

FIG. 12 illustrates a circular embodiment of the device suitable for use in a RAM-SET gun. A plurality of cartridges 80 are mounted in a circular pattern or a circular base 82. A central axis hole 84 which fits over a central pin in the gun (not shown) permits the base 82 to be rotated. Drive holes 86 are used by the drive mechanism of the gun to rotate each cartridge 80 in succession into the firing chamber of the gun. The cartridges 80 are cylindrical and fit in frusto conical bases 88 formed in the base 82. The tops 90 of the cartridges 82 are crimped to enclose the powder inside the cartridge 82.

The plastic-cased propellant magazine, according to the invention, has a number of important advantages over similar devices available commercially. Some of the advantages are:

(1) The use of expensive non-ferrous metal (brass) is greatly reduced.

(2) The complexity and expense of manufacturing a deep-drawn annealed cartridge from non-ferrous (brass) metal is reduced.

(3) The use of a skirt and a curled lip at the top of the cap wall, fitting in a channel in the cartridge wall, virtually eliminates detrimental reverse gas leakage.

(4) The problem of ignition of adjacent propellant charges is eliminated without the necessity of displacing the propellant charge into a separate combustion chamber for ignition.

(5) For the embodiment that includes stepped exterior surfaces on the conical projections (FIGS. 5 and 6), the disadvantage of reduced sealing capability in the chamber (as described in U.S. Pat. No. 4,565,114 and experienced with conical projections with a straight side cone angle greater than that of the chamber of the gun) is reduced. The non-conical stepped projections of the invention provide multiple sealing points and a shock absorption cavity between the projections and the barrel chamber.

(6) For the solid powder embodiment (FIG. 7) the disadvantages of deposits of impurities into the firing mechanism of the bolt setting gun are eliminated as the charge residues remain in the case and are removed during the feed-out of the magazine strip.

(7) For the embodiment with a thermo-plastic base closure containing a ring-shaped priming compound enclosure formed from non-ferrous metal (FIGS. 9 to 11) the expense of using brass to form the bottom and side walls of the end cap are eliminated. The precision tolerances required of the stamping dies are avoided, thus eliminating the cost of maintaining precision equipment suitable for high volume production of drawn metal parts. A material of great tensile strength, such as carbon-fibre impregnated thermo-plastic, forms the non-metal component of the embodiment. The base closures are held in place by a radial inwardly extending projection recessed into an undercut provided in the skirt-base of the plastic propellant casing.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A propellant containing device for use in association with a gun which is adapted to utilize the propellant to drive an attachment member into a structure comprising:

(a) a base;

(b) means on the base to enable the base to be moved by a movement mechanism in the gun;

(c) a plurality of hollow members each integral with the base, the members being closed at the end removed from the base and open at the end adjacent the base, each opening in the base having an annular groove therearound; and (d) a plurality of closure means adapted to fit within the openings in the base, each closure means having a peripheral rim which fits in the annular groove surrounding the opening of the base.

2. A device as claimed in claim 1 wherein the portion of the base between the opening and the opening facing side of the annular groove extends to a length sufficient to provide a barrier between the interior of the hollow members and the closure means when assembled.

3. A device as claimed in claim 2 wherein the thickness of the wall of each of the hollow members is less at the region of the members remote from the base and greater at the region of the members proximate to the base.

4. A device as claimed in claim 3 wherein the exterior surface of each of the hollow members is in the form of a cone with a rounded top remote from the base.

5. A device as claimed in claim 4 wherein the rounded top region of the conical hollow member is weakened by at least one crease.

6. A device as claimed in claim 5 wherein the means on the base for permitting movement of the base by the gun comprises a series of discrete openings on at least one side of the base which openings are adapted to engage a drive mechanism in the gun.

7. A device as claimed in claim 4 wherein the exterior surface of the cone has thereon at least one raised portion.

8. A device as claimed in claim 7 wherein the raised portion extends around the circumpherence of the cone.

9. A device as claimed in claim 1 wherein the rim of the closure means has a projection thereon which enhances mating of the rim of the closure means with the annular groove.

10. A device as claimed in claim 9 wherein the width of the interior of the annular groove is expanded relative to the exterior region of the groove, the expanded interior of the groove being adapted to mate with the projection of the rim of the closure means to enhance and maintain the assembly of the closure means and the base.

11. A device as claimed in claim 10 wherein the projection extends inwardly from the edge of the peripheral rim.

12. A device as claimed in claim 11 including a peripheral channel on the inner surface of the bottom of the annular groove and a flange extending inwardly from the rim of the closure means adapted to engage the channel to secure the closure means to the member.

13. A device as claimed in claim 11 wherein the closure means is formed of plastic.

14. A device as claimed in claim 13 wherein the interiors of the hollow members contain gunpowder, and a primer a part of which is enclosed between two opposing non-ferrous metal pieces.

15. A device as claimed in claim 11 wherein the closure means is formed of non-ferrous metal.

16. A device as claimed in claim 15 wherein the interiors of the hollow members contain gunpowder.

17. A device as claimed in claim 16 wherein the gunpowder is in the form of a tablet.

18. A device as claimed in claim 16 wherein the interiors of the hollow members contain a primer.

19. A device as claimed in claim 18 wherein the primer is adjacent the closure means.

20. A device as claimed in claim 18 wherein piezoelectric means are associated with the closure means and are utilized to ignite the primer.

21. A propellant containing device for use in association with a gun which is adapted by means of a detonation device to utilize the propellant to drive an attachment member into a structure comprising:

(a) a base:

(b) drive receiving means formed on the base whereby the base may be driven to align with the detonation device;

(c) a plurality of hollow cartridge members formed integrally with the base, each cartridge member being open at the base and containing an explosive charge;

(d) a percussion cap adapted to fit in each cartridge opening, the cap holding a primer to ignite the explosive charge in the cartridge member;

(e) a circumferential recess around the opening in each cartridge member to receive the respective percussion cap, the circumferential recess having a widened portion at its inner end remote from the base;;

(f) a circumferential skirt defining a radially inward surface of the recess and separating the recess from the interior of the respective cartridge members, the skirt extending from the widened portion of the circumferential recess to a position proximate to the percussion caps; and (g) an upstanding wall formed around the periphery of each percussion cap to engage the interior of the recess; the upper end of the upstanding wall having a flange to engage the widened portion of the circumferential recess.

22. A device as claimed in claim 21 wherein the percussion cap is formed of brass.

23. A device as claimed in claim 21 wherein the base is elongate.

24. A device as claimed in claim 21 wherein the base is circular.

25. A device as claimed in claim 21 wherein the cartridge member is closed at the end remote from the base.

26. A device as claimed in claim 25 wherein lines of weakness are formed in the closed end of the cartridge member.

27. A device as claimed in claim 21 wherein the cartridge is molded from a heat extrudable polymer.

28. A device as claimed in claim 27 wherein the polymer is selected from polyvinylchloride and polyethylene.

* * * * *